US010485289B2

(12) United States Patent
Frank

(10) Patent No.: US 10,485,289 B2
(45) Date of Patent: Nov. 26, 2019

(54) SAFETY SLIPPER

(71) Applicant: ALBAHEALTH, LLC, Rockwood, TN (US)

(72) Inventor: Mary H. Frank, Cookeville, TN (US)

(73) Assignee: ALBAHEALTH, LLC, Rockwood, TN (US)

( * ) Notice: Subject to any disclaimer, the term of this patent is extended or adjusted under 35 U.S.C. 154(b) by 60 days.

(21) Appl. No.: 15/445,103

(22) Filed: Feb. 28, 2017

(65) Prior Publication Data

US 2017/0164681 A1 Jun. 15, 2017

Related U.S. Application Data

(63) Continuation-in-part of application No. 13/271,462, filed on Oct. 12, 2011, now abandoned.

(51) Int. Cl.

| | |
|---|---|
| ***A43B 3/10*** | (2006.01) |
| ***A43B 13/22*** | (2006.01) |
| ***A43B 1/04*** | (2006.01) |
| ***A43B 3/12*** | (2006.01) |
| ***A43B 5/08*** | (2006.01) |
| ***A43B 13/02*** | (2006.01) |
| ***A43B 23/02*** | (2006.01) |
| ***A43C 15/00*** | (2006.01) |

(52) U.S. Cl.

CPC ..... *A43B 3/108* (2013.01); *A43B 1/04* (2013.01); *A43B 3/101* (2013.01); *A43B 3/128* (2013.01); *A43B 5/08* (2013.01); *A43B 13/026* (2013.01); *A43B 13/22* (2013.01); *A43B 23/025* (2013.01); *A43B 23/0215* (2013.01); *A43C 15/00* (2013.01)

(58) Field of Classification Search

CPC ..... A43B 3/108; A43B 3/04; A43B 3/107; A43B 3/101; A43B 13/04; A43B 7/087; A43B 1/14; A43B 13/22

USPC ..... 2/239, 240, 242; 36/21, 57, 8.1, 9 R, 36/59 R

See application file for complete search history.

(56) References Cited

U.S. PATENT DOCUMENTS

| | | | | |
|---|---|---|---|---|
| 193,077 | A | 7/1877 | Clayton | |
| 1,433,309 | A | 10/1922 | Stimpson | |
| 1,597,934 | A | 8/1926 | Stimpson | |
| 2,041,505 | A | 5/1936 | Woerle | |
| 3,299,540 | A | 1/1967 | Scholl | |
| 4,021,860 | A | 5/1977 | Swallow et al. | |
| 4,069,515 | A | 1/1978 | Swallow et al. | |
| 4,651,354 | A * | 3/1987 | Petrey | A41B 11/004 2/239 |
| 4,825,564 | A | 5/1989 | Sorce | |

(Continued)

OTHER PUBLICATIONS

Web site showing photo of Care-Steps socks, 2009.
Web site showing photo of Nova Plus socks, 2009.

*Primary Examiner* — Katharine Gracz
(74) *Attorney, Agent, or Firm* — Baker Donelson; Dorian B. Kennedy

(57) ABSTRACT

A safety slipper (10) includes a stretchable fabric material upper portion (12) and a porous anti-skid lower portion. The upper portion has a foot opening (16) and a profile heel pocket (17). The lower portion (13) is made from a scrim cloth type material having a knit of polyester threads (21) coated with a soft poly-vinyl chloride outer layer (22). The lower portion provides for a cris-crossing pattern or matrix of interconnected nodes (23) with spaces (24) therebetween.

12 Claims, 2 Drawing Sheets

(56) References Cited

U.S. PATENT DOCUMENTS

| | | | | |
|---|---|---|---|---|
| 5,035,069 | A | 7/1991 | Minden | |
| 5,222,313 | A | 6/1993 | Dowdy et al. | |
| 5,412,957 | A | 5/1995 | Bradberry et al. | |
| 5,749,100 | A | 5/1998 | Rosenberg | |
| 6,378,139 | B1 | 4/2002 | Mazzaglia | |
| 6,625,903 | B2 | 9/2003 | Swango et al. | |
| 6,766,536 | B1 * | 7/2004 | Aarons | A41B 11/008 2/161.3 |
| 7,310,894 | B1 | 12/2007 | Schwarzman et al. | |
| 7,346,935 | B1 * | 3/2008 | Patterson | A41B 11/004 2/239 |
| 7,562,541 | B2 | 7/2009 | Hermanson et al. | |
| 7,775,069 | B1 | 8/2010 | Hermanson et al. | |
| 2002/0011146 | A1 | 1/2002 | Vaz | |
| 2002/0148138 | A1 | 10/2002 | Egan | |
| 2004/0139629 | A1 | 7/2004 | Wiener | |
| 2004/0221371 | A1 * | 11/2004 | Kato | A41B 11/008 2/239 |
| 2005/0091729 | A1 * | 5/2005 | Alley | A41B 11/004 2/239 |
| 2006/0143802 | A1 | 7/2006 | Butz | |
| 2007/0251121 | A1 | 11/2007 | Thomas | |
| 2008/0032056 | A1 | 2/2008 | Whang et al. | |
| 2009/0071041 | A1 | 3/2009 | Hooper | |
| 2009/0172867 | A1 | 7/2009 | Kopp et al. | |
| 2009/0241244 | A1 | 10/2009 | Butz | |
| 2011/0162129 | A1 | 7/2011 | Ott et al. | |

* cited by examiner

SAFETY SLIPPER

REFERENCE TO RELATED APPLICATION

This is a continuation-in-part of U.S. patent application Ser. No. 13/271,462 filed Oct. 12, 2011.

TECHNICAL FIELD

This invention relates generally to slippers and more specifically to non-slip safety slippers.

BACKGROUND OF THE INVENTION

Heretofore, safety footwear have been designed in the form of a sock which includes a pattern of flexible material applied to the bottom side of the sock. The purpose of the flexible material is to restrict slippage as the wearer stands or walks upon a floor. These types of socks may be used by medical patients, yoga participants, or people relaxing at home.

While the patterned, flexible material provides increased traction, such may still result in foot slippage upon the underlying floor. Furthermore, these types of stockings are not designed to be worn in a shower or other type of wet environment.

Accordingly, it is seen that a need remains for safety foot wear that provides a better slip resistance and that may be worn in a wet environment. It is to the provision of such therefore that the present invention is primarily directed.

SUMMARY OF THE INVENTION

In a preferred form of the invention a safety slipper comprises a stretchable fabric material forming an upper portion having a foot opening therein and a non-skid tread coupled to the upper portion. The non-skid tread has a matrix of holes therethrough which are sized to allow the passage of water through the non-skid tread.

DETAILED DESCRIPTION

Figure 1:
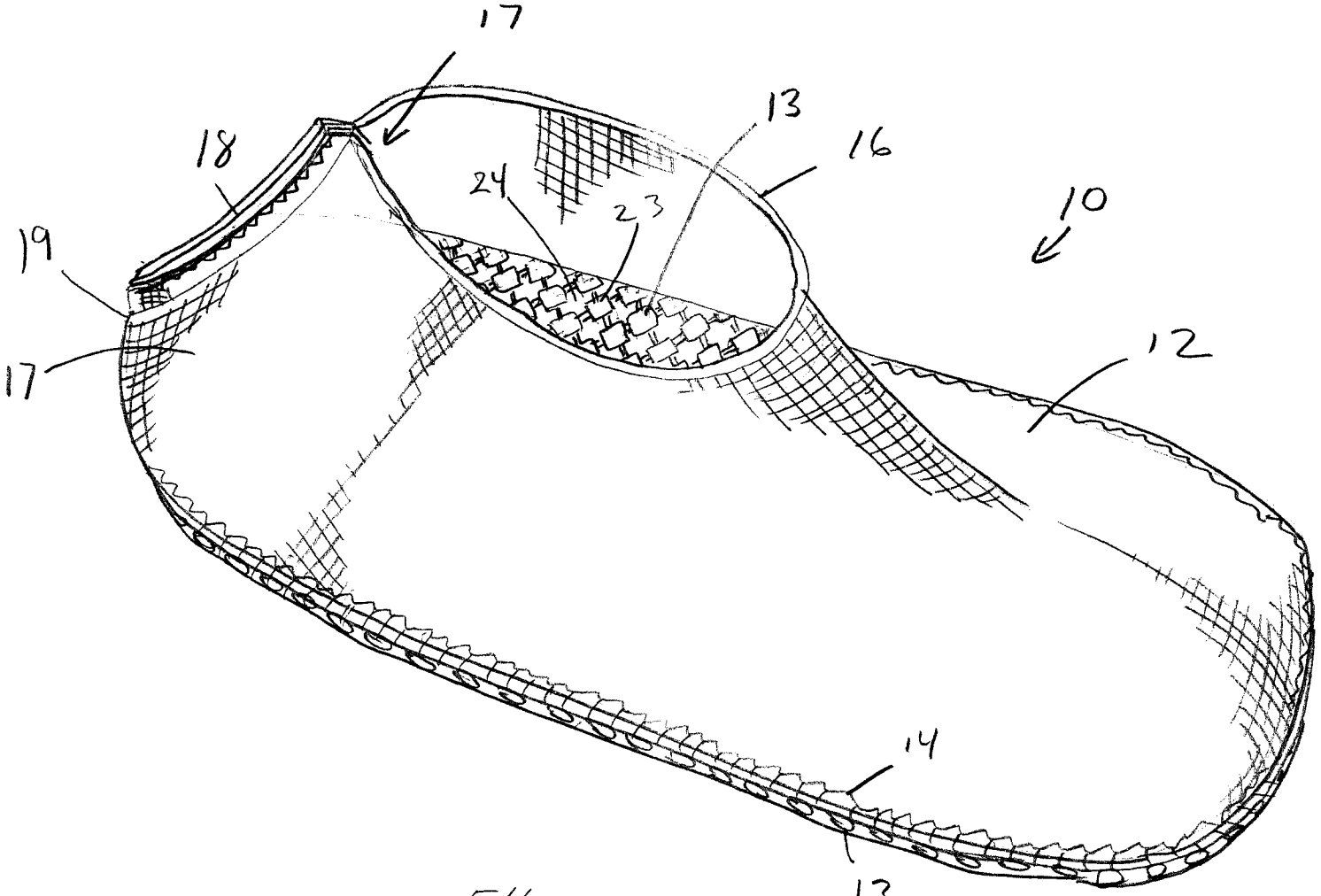
FIG. 1 is a perspective view of a preferred form of the safety slipper.
Figure 2:
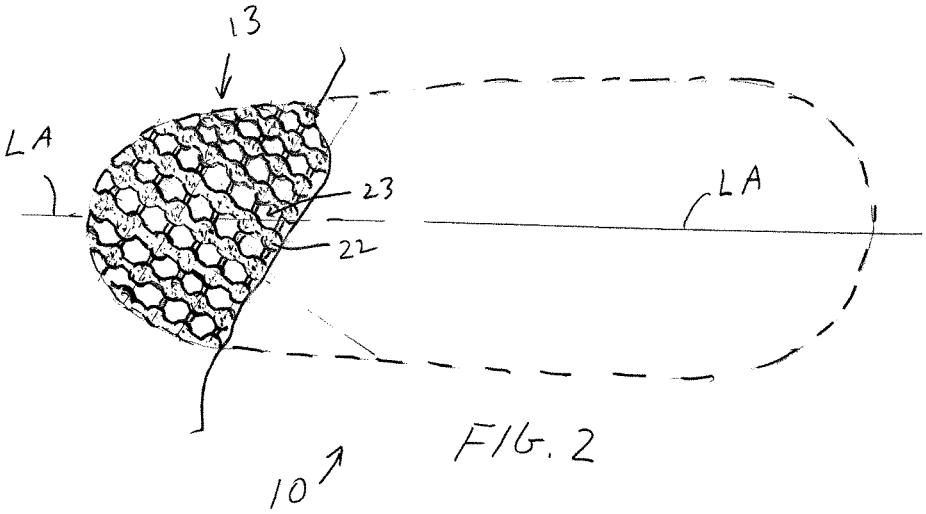
FIG. 2 is a bottom view of the safety slipper of FIG. 1.

With reference next to the drawings, there is shown a safety slipper or footwear 10 in a preferred form of the invention. The slipper 10 has an elastic, stretchable fabric material upper portion 12 and a porous anti-skid lower portion, sole, or tread 13 joined to the upper portion 12 along their outwardly turned mutual peripheral edges by a side seam 14. The upper portion 12 is configured to fit closely about the foot of a wearer. The slipper may, of course, be produced in any number of overall sizes to fit people of different foot sizes.

The upper portion 12 has a top or foot opening 16 and a profile heel pocket 17 formed by an anterior heel seam 18 set at an angle from the anterior end 19 of the slipper 10. The heel seam 18 is formed by the aft ends of the stretchable fabric material being joined together with the fabric edges facing outwardly so as not to rub against the skin of the wearer. The upper portion 12 is formed from a material having stretch properties such as a warp or weft knit material comprised of 90 percent nylon fibers and 10 percent elastane fibers (also known under the tradename Spandex). The anterior heel seam 18 is set approximately 15 degrees inwardly from vertical to help prevent the upper portion from repositioning during the patient's gait or other movement. The heel seem 18 is formed by sewing a gore seam with the material edges facing outwardly, similarly to the joiner of the upper and lower portions, so that the raw edges do not rub against and thereby cause irritation to the skin of the wearer.

Figure 3:
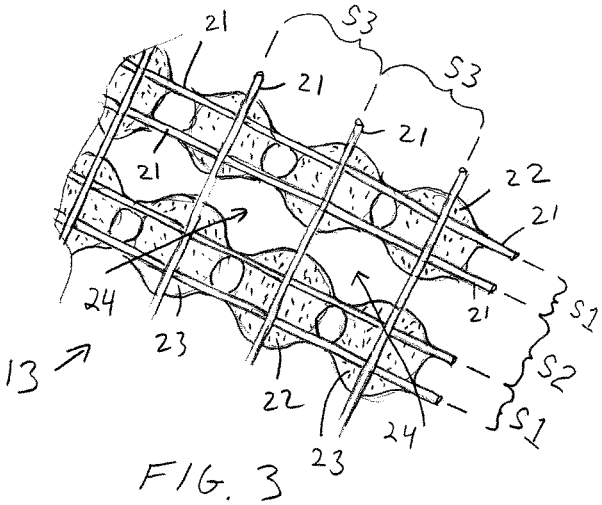
FIG. 3 is a partial cross-sectional plan view of the lower portion of the safety slipper of FIG. 1.

The lower portion 13 is generally symmetrical along a longitudinal axis LA so that the slipper may be worn on either foot, i.e., the slipper is not formed to fit a particular foot but may be worn on either the right or left foot. The lower portion 13 is made from a mesh material such as a scrim cloth type material having a knit of polyester threads 21 coated with a soft poly-vinyl chloride outer layer 22, as best shown in FIG. 3 which shows a top portion of the outer layer 22 removed to clearly depict the internal threads 21. The term "mesh" is defined herein as a knit or weave of material wherein threads criss-cross each other, and is not intended to mean a solid material having a series of holes therein. The outer layer 22 is preferably made of a poly-vinyl chloride material having an approximately 35 to 45 durometer reading, which will provide a coefficient of friction of greater than 1.

The scrim cloth type material of the lower portion provides for a criss-crossing pattern or matrix of interconnected nodes, lines, bumps, bulges, etc. 23 defining a linear series or array of continuous spaces, interstices, holes, or pores 24 therebetween, the holes 24 are considered to be continuous because the extend from one to another separated only by a thread 21 positioned within a only a portion of the hole. The term "matrix" as used herein is defined as an arrangement of holes in a rectangular array of rows and columns. The holes 24 are shown in FIG. 3 as a row of interconnected holes 24 extending generally laterally along select spacing S3 described hereinafter. This may also be thought of as a poly-vinyl material having a criss-crossing pattern or matrix of spaces, holes or pores 24 therethrough. For example purposes only, the lower portion 13 may have a select spacing in a first direction of 1/16 of an inch between adjacent pairs of threads 21, designated as S1, and 1/8 of an inch spacing between the adjacent pairs, designated as S2, and a select spacing in a second direction of 3/16 of an inch, designated as S3.

In use, a person may don the slipper by simply sliding a foot through the foot opening 16 and into position within the slipper 10. The high friction coefficient of the slipper diminishes the risk associated with a person wearing such in a wet, slippery or high risk area. The slipper may also be worn by a person during bathing or showering or when walking across a variety of wet floor conditions, as water is allowed to pass through the "sole" of the slipper by passing between the matrix of nodes 23 and through the matrix of spaces 24. This free flow through the slipper also prevents the accumulation of water within the slipper and resulting weighting of the slipper.

The porous nature of the lower portion 13 allows moisture to flow freely to and from the surface of the underlying floor, thus reducing the hydroplaning effect which may occur in other types of footwear. The goal of reducing slippage is extremely desirous to healthcare, home care, and hospital facilities and the like as such may result in great bodily harm to the weak or elderly, or where normal gait has been affected and may result in greater liability to the medical facility. The poly-vinyl chloride material also possesses a high tensile strength to help reduce the chance of shearing in the sole portion of the slipper and is resistant to many chemical fluids, thus resisting the breaking down when exposed to such.

It should be understood that as used herein the term weave or knit may be used interchangeably.

It should be understood that the nodes 23 may be joined together in linear fashion so as to form elongated lines or strings of non-skid material, rather than individual nodes, with spaces between adjacent lines of material to allow the passage of water therethrough. As such, the term node may be used herein to describe an elongated formation of material.

It thus is seen that a safety slipper is now provided that provides greater non-skid capabilities. Although the slipper has been illustrated and described in its preferred form, it should be understood that many modifications, additions and deletions may be made to that specific form without departure from the spirit and scope of the invention as set forth in the following claims.

The invention claimed is:

1. A safety slipper comprising:

a stretchable fabric material forming an upper portion having a foot opening therein; and a non-skid tread coupled to said upper portion, said non-skid tread having a matrix of holes therethrough which are sized to allow the passage of water through said non-skid tread, said matrix of holes being defined by a criss-crossing pattern of threads coated with a polymer material.

2. The safety slipper of claim 1 wherein said non-skid tread is scrim material coated with a poly-vinyl chloride material.

3. The safety slipper of claim 2 wherein said non-skid tread is a knit of threads coated with a poly-vinyl chloride layer.

4. The safety slipper of claim 1 wherein said safety slipper has a heel seam extending from said non-skid tread to said foot opening, and wherein said heel seam is oriented at an inward angle from said non-skid tread to said foot opening.

5. The safety slipper of claim 4 wherein said seam is formed from two aft ends of said stretchable fabric material and wherein said two aft ends are joined together in an outwardly facing fashion.

6. The safety slipper of claim 1 wherein said upper portion is coupled to said lower portion with the peripheral edges of both said upper portion and said lower portion facing outwardly.

7. The safety slipper of claim 6 wherein said matrix of holes includes rows of interconnected holes.

8. A safety slipper comprising, an upper portion, a lower portion coupled to said upper portion, said lower portion being a mesh of threads coated with a poly-vinyl chloride material, said mesh of threads with coated poly-vinyl chloride material being configured to have interstices between adjacent rows of threads with poly-vinyl chloride material to allow the passage of water therethrough.

9. The safety slipper of claim 8 wherein said mesh is a knit of fibers coated with a poly-vinyl chloride layer.

10. The safety slipper of claim 8 wherein said upper portion is coupled to said lower portion with the peripheral edges of both said upper portion and said lower portion facing outwardly.

11. The safety slipper of claim 8 wherein said interstices have a linear series of interconnected holes.

12. The safety slipper of claim 8 wherein said safety slipper upper portion has a heel scam extending from said lower portion to a foot opening within said upper portion, and wherein said heel seam is oriented at an inward angle from said lower portion to said foot opening.

* * * * *